United States Patent [19]

Barna

[11] 4,259,750

[45] Apr. 7, 1981

[54] TROUSER FLY

[76] Inventor: Alex J. Barna, 1216 Crawford St., Duquesne, Pa. 15110

[21] Appl. No.: 128,903

[22] Filed: Mar. 10, 1980

[51] Int. Cl.[3] ..... A41D 1/06

[52] U.S. Cl. ..... 2/234

[58] Field of Search ..... 2/234, 227, 79, 228, 2/235

[56] References Cited

U.S. PATENT DOCUMENTS

| | | | |
|---|---|---|---|
| 1,832,687 | 11/1931 | Boshnack | 2/234 |
| 2,285,692 | 6/1942 | Wickman | 2/227 |
| 2,585,175 | 2/1952 | Rosenberg | 2/234 |
| 2,971,200 | 2/1961 | Lindsey | 2/234 X |
| 3,092,840 | 6/1963 | Roberts | 2/234 |

*Primary Examiner*—H. Hampton Hunter

*Attorney, Agent, or Firm*—Stanley J. Price, Jr.; John M. Adams

[57] ABSTRACT

A trouser construction includes a conventional fly portion formed by a pair of overlapping flaps integral with the waist portion of the trouser and including a conventional slide fastener. In one embodiment a second or imitation fly portion is removably attached to the waist portion in overlying relation with the first or conventional fly portion to simulate the appearance of the trousers being worn with the fly in an open position. The imitation fly portion includes a flexible backing having spaced apart strips that support in a converging arrangement a pair of track elements or rows of teeth. Associated with the track elements is a fly closure device that is maintained in a lowermost position to present the appearance of an open fly where the backing simulates an exposed portion of the garment worn under the trousers. In a second embodiment the imitation fly portion is formed integral with the overlapping flaps of the conventional fly portion. A pair of fastener track elements are stitched to the respective flaps of the conventional fly portions so that when the conventional fly portion is closed the track elements simulate the appearance that the trousers are worn with the fly portion in an open position.

15 Claims, 7 Drawing Figures

TROUSER FLY

BACKGROUND OF THE INVENTION

1. Field of the Invention

This invention relates to an article of wearing apparel and more particularly to a trouser fly construction that includes an imitation fly portion adapted to be worn with a pair of trousers to present the appearance when the trousers are worn that the fly portion is in an open position.

2. Description of the Prior Art

It is well known in the art of wearing apparel to modify the construction of wearing apparel such as trousers and the like to enhance the utility of the wearing apparel and provide multiple uses or varied ornamental appearances of the wearing apparel. For example, U.S. Pat. Nos. 2,585,175 and 2,206,505 disclose trousers that disclose modifications to the waist portion and fly portion which in one case facilitates waist adjustability while preserving a neat appearance of the trousers and particularly the waist and fly portions and in another case modifies the trouser construction to insure support on the wearer while participating in athletic activity.

It is also known to provide outer garments constructed to provide freedom of action and present a neat appearance while engaging in athletic sports. An example of such an outer garment is disclosed in U.S. Pat. No. 3,110,903 which uses a plurality of conventional slide fasteners, such as the well known zipper, with garments for men and women that permit the garment to be quickly converted in public from a fashion garment for working hours to a sport garment which provides the free action construction desirable in athletic sports.

Attachments to articles of wearing apparel and devices for removably engaging one item of wearing apparel with another item are also well known in the art as exemplified by U.S. Pat. Nos. 2,396,446 and 3,085,247. These patents disclose attachments to the conventional necktie for use as a necktie protector and clips associated with the necktie for attaching it to the neckband of a shirt. These devices include fastening means associated with the knot portions of bow ties, as well as, conventional four-in-hand ties. It is also a known practice to decorate articles of clothing by permanently attaching some form of decoration to the basic article. Removably attaching a novel or decorative item to wearing apparel to facilitate the removal or interchange of decorative and novelty items on wearing apparel is disclosed in U.S. Pat. No. 2,726,397.

Therefore, there is need to provide conventional items of wearing apparel, such as trousers and the like, with attachments of a decorative and novel subject matter which can be conveniently worn with the trousers or removed therefrom according to the desires of the wearer.

SUMMARY OF THE INVENTION

In accordance with the present invention there is provided an article of wearing apparel that includes a trouser construction including a waist portion and a first fly portion. The first fly portion is attached to the waist portion. Means is associated with the first fly portion for opening and closing the first fly portion. A second fly portion is connected to the waist portion in overlying relation with the first fly portion. The second fly portion includes a backing positioned on and substantially concealing the first fly portion when the first fly portion is closed. The backing has a pair of spaced apart elongated edge portions extending downwardly a preselected distance from the waist portion. Fastener elements are secured in overlapping relation to each of the edge portions respectively. The fastener elements are spaced apart a distance increasing in width from the lower ends thereof to the upper ends thereof adjacent the waist portion to present the appearance of the trouser construction as having a fly portion in an opened position.

The first fly portion is formed integrally with the waist portion. The second fly portion is removably attached to the trouser construction in overlying relation with the first fly portion. Suitable devices such as hooks, cooperating snap devices, Velcro closure strips, and the like are attached to the trouser construction and the second fly portion so as to removably secure the second fly portion to the trouser construction in overlying relation with the first fly portion to thereby conceal the first fly portion.

The fastener elements include elongated strips of tape suitably attached to the elongated edge portions of the backing. The strips of tape each have upper and lower end portions. The strips of tape are positioned on the backing with the upper end portions spaced a greater distance apart than the lower end portions so that the strips of tape converge toward one another in a direction from the upper end portions to the lower end portions. A fly closure device connects the strips of tape at the lower end portions thereof for simulating the second fly portion in an open position.

A portion of the backing is exposed between the spaced apart strips of tape. Preferably, the fabric is a material having a uniform construction which contrasts with the trouser construction. Thus, the backing is clearly distinguishable from the trouser construction to present the appearance of exposing the garment worn under the trouser construction.

Further, in accordance with the present invention there is provided an article of wearing apparel that includes a trouser construction including a waist portion and a first fly portion. The first fly portion has a pair of flaps. Fastener means are secured to the first fly portion for moving the pair of flaps into and out of overlapping relationship to close and open the first fly portion respectively. A second fly portion is positioned in overlying relationship with the first fly portion. The second fly portion includes a two part backing that is secured to and covers the pair of flaps so that the backing parts are arranged in overlapping relationship when the first fly portion is closed. Fly fastener elements are secured to the respective parts of the backing in a position to simulate the appearance of the trouser construction having the trouser fly portion in an opened position when the first fly portion is closed.

The present invention is also directed to an attachment to a trouser construction that includes a flexible backing having a pair of elongated side edges. Means are provided for releasably securing the backing to the trouser construction. A pair of strips are secured to the pair of side edges respectively. The pair of strips each have an upper end portion and a lower end portion. The strips are positioned on the backing with the upper end portions spaced a greater distance apart than the lower end portions so that the strips converge toward one another in a direction from the upper end portions to the lower end portions. A portion of the backing is exposed between the pair of strips. Fly closure means are secured to the pair of strips for simulating the appearance of a fly portion for the trouser construction. The fly closure means is positioned on the pair of strips to present the appearance of a fly portion in an open position.

Accordingly, the principal object of the present invention is to provide an article of wearing apparel that includes a trouser construction having first and second fly portions in which the fly portions are positioned in overlying relationship in a manner that simulates the appearance of the trouser construction having an open fly portion where in fact the actual fly portion of the trouser construction is closed.

Another object of the present invention is to provide an article of wearing apparel that includes a pair of overlying fly portions secured integrally with the trouser construction where a first fly portion is conventionally operable between open and closed positions and a second fly portion overlies the first fly portion in a manner to create the impression when the first fly portion is closed that the trouser construction is worn with the fly open.

An additional object of the present invention is to provide an attachment to a trouser construction that includes a removable fly portion adapted to engage the trouser construction in overlying relation with the conventional fly portion of the trouser construction and simulate on the trouser construction that the fly portion is in an open position with the garment worn beneath the trouser construction being exposed.

These and other objects of the present invention will be more completely disclosed and described in the following specification, the accompanying drawings, and the appended claims.

DESCRIPTION OF THE PREFERRED EMBODIMENTS

Figure 1:
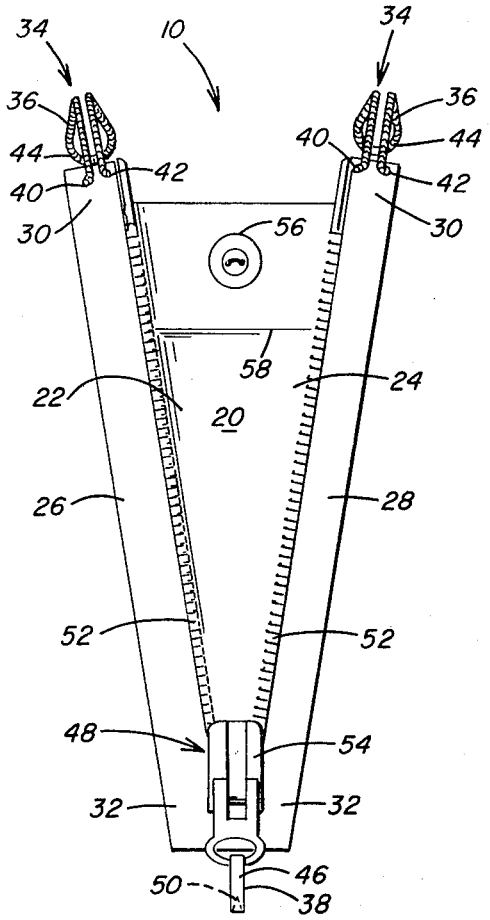
FIG. 1 is a plan view of a removable fly construction adapted to be attached in overlying relationship with the conventional fly portion of a pair of trousers.
Figure 2:
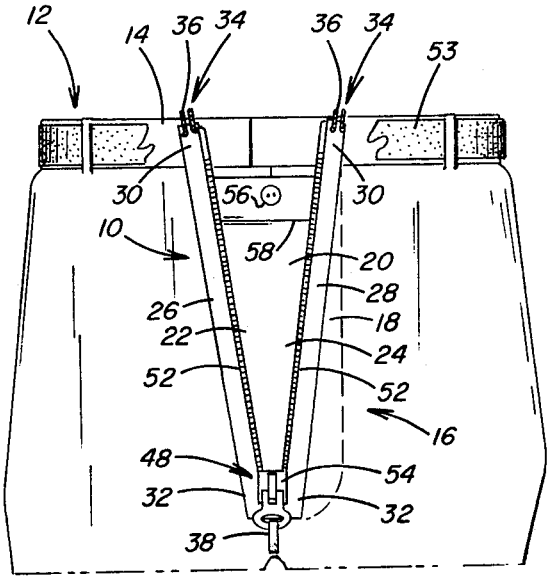
FIG. 2 is a fragmentary schematic view in elevation of one embodiment of trouser construction, illustrating the removable fly construction shown in FIG. 1 secured to the trouser construction to present the appearance that the trousers are worn with the fly in an open position.
Figure 3:
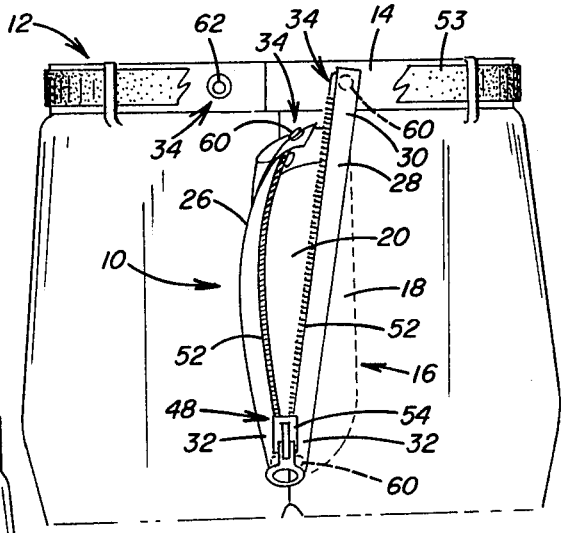
FIG. 3 is a fragmentary schematic view in elevation similar to FIG. 2, illustrating cooperating snaps on the trouser construction and the removable fly.

Referring to the drawings and particularly to FIGS. 1–3 there is illustrated an attachment generally designated by the numeral 10 for releasable engagement with trousers 12 of a conventional construction having a waist portion 14 and a conventional fly portion 16 formed integrally with the waist portion 14. The fly portion 16 includes a pair of overlapping flaps. A first flap 18 overlies a second flap (not shown) so that the second flap is concealed by the first flap 18 when the trousers are worn in a conventional manner.

The integral fly portion 16 also includes a conventional fastener (not shown) such as a zipper construction having two rows of teeth on strips of tape which are sewn to the respective flaps and a sliding piece that closes the opening between the flaps by drawing the teeth into meshing relation. This construction is well known in the art. The attachment 10 is removably connected to the trousers 12 in overlying relationship with the fly portion 16 so that when worn on the trousers 12 it presents an appearance or illusion that the trousers are being worn with the fly in an open position where in fact the fly portion 16 is closed and the attachment 10 is a false or imitation fly.

As illustrated in FIG. 1 the attachment 10 is constructed to appear as a fly portion of trousers in an open position. FIG. 2 illustrates the attachment or second fly portion 10 secured in overlying relation with the conventional, first fly portion 16 of the trousers 12. The attachment or second fly portion 10 includes a flexible backing 20 having a pair of elongated side edges 22 and 24. A pair of strips 26 and 28 are secured in a suitable manner in overlying relation with the side edges 22 and 24 respectively.

Each of the strips 26 and 28 includes an upper end portion 30 and a lower end portion 32. The strips 26 and 28 are positioned on the backing 20 with the upper end portions 30 spaced a greater distance apart than the lower end portions 32. With this arrangement the strips 26 and 28 converge toward one another in a direction from the upper end portions 30 to the lower end portions 32.

The attachment or second fly portion 10 is releasably engagable with the trousers 12 in overlying relation with the fly portion 16 that is formed integral with the trousers 12. The attachment 10 is connected to the trousers 12 by engaging devices generally designated by the numeral 34 in FIGS. 1–4. As illustrated in FIGS. 1 and 2 the engaging devices 34 include in one embodiment a pair of hooks 36 secured to the strip upper end portions 30 and a hook 38 attached to the removable fly portion 10 to extend below the strip lower end portions 32.

The pair of hooks 36 are preferably constructed of a flexible wire-like material. Each of the hooks includes individual end portions 40 and a looped end portion 44. The hook 38 is a substantially rigid member having a shank portion 46 which is suitably connected to a fastener device generally designated by the numeral 48. The shank portion 46 terminates in an in-turned, prong-like end portion 50. The pronged end portion 50 is adapted to embed into the material comprising the trousers 12.

In accordance with the present invention the fly construction 10 of FIG. 1 is adaptable to be releasably secured to the trousers 12 in the position illustrated in FIG. 2. With the fly portion 16 of the trousers 12 in a closed position, the fly construction 10 is positioned in overlying relation with the fly portion 16. The pair of hooks 36 are looped over the waist portion 14 so that the waist portion 14 is positioned between the looped end portions 44 on the inside of the waist portion 14 and the ends 40 and 42 engaging the outside of the waist portion 14. The hooks 36 in this position are compressed to frictionally engage the waist portion 14 thereby securing the upper end portions 30 of the strips 26 and 28 to the trousers 12.

With the fly construction 10 secured to the trousers 12, the flexible backing 20 and strips 26 and 28 extend downwardly to lie substantially on the first flap 18 of the fly portion 16. The lower hook 38 extends downwardly so that the pronged end portion 50 engages the trousers 12. With this arrangement, the fly construction 10 is fully extended to lie flat on the trousers fly portion 16.

When the fly portion 10 is positioned on the trousers 12, a belt 53 when worn with the trousers 12 overlies the strip upper end portions 30 and the pair of hooks 36. This arrangement conceals the manner in which the attached fly construction 10 is mounted on the trousers 12. Also with the pronged end portion 50 being turned inwardly it is not readily apparent that the lower end of the fly construction 10 is removably connected to the trousers 12.

The fastener device 48 includes the basic components of a conventional zipper-type fastener. A track or row of teeth 52 are suitably secured to the edges of the strips 26 and 28 that overly the backing side edges 22 and 24. A slide portion 54 is positioned at the strip lower end portions 32 and engages the row of teeth 52. In this position of the slide portion 54, the fly construction 10 is in an open position.

In accordance with the present invention the removable fly construction 10 is maintained in the open position on the trousers 12, as illustrated in FIG. 2, to simulate the appearance that the trousers 12 are being worn with the fly in an open position. However, the conventional fly portion 16 of the trousers 12 is closed; while, the removable fly construction 10 presents a false impression that the fly is open.

Further in accordance with the present invention the flexible backing 20 preferably includes a cloth material having a uniform construction throughout. Preferably, the cloth backing 20 has a color, texture, and design which contrasts visibly with the trouser construction, color, and design so that the backing 20 is clearly distinguishable from the trousers 12. Further the cloth backing 20 may also include suitable ornamentation such as a button 56 stitched to the upper end of the backing 20 and further a border 58 extending below and spaced from the button 56. This arrangement is intended to simulate the appearance that the trousers 12 are being worn with the fly portion open and the garment worn underneath the trousers exposed.

Not only can the removable fly construction 10 be secured to the trousers 12 by the hooks 36 and 38 but cooperating snap devices 60 and 62 can also be utilized as illustrated in FIG. 3. The snap devices 60 are secured to the fly construction 10 and are removably engageable with the corresponding snap devices 62 provided on the trousers waist portion 14. Pairs of cooperating snap devices 60 and 62 secure the strip upper end portions 30 to the waist portion 14. A snap device 60 is also secured to the underside of the backing 12 opposite the slide portion 54 for engagement with a cooperating snap device (not shown) secured to the trousers 12. Thus when the cooperating snap devices 60 and 62 are engaged the removable fly construction 10 is positioned in overlying relationship with the trousers fly portion 16 to conceal the fly portion 16.

Figure 4:
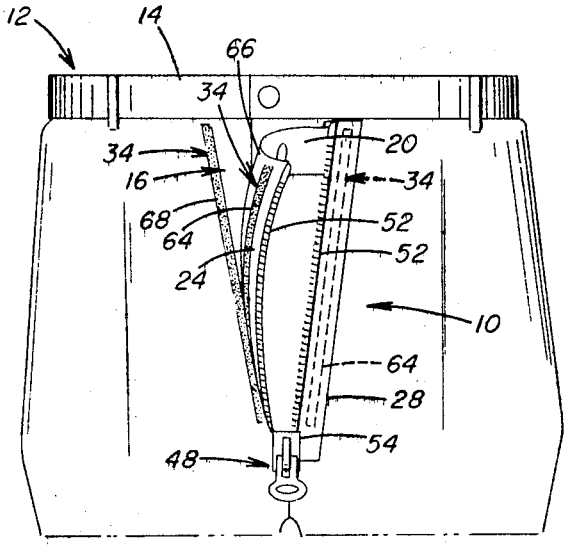
FIG. 4 is another view similar to FIG. 3 illustrating the removable fly construction attached to the trousers by interlocking Velcro strips.

Further in accordance with the present invention the removable fly construction 10 is releasably secured to the trousers 12, as illustrated in FIG. 4, by cooperating Velcro closure strips on the fly construction 10 and the trousers 12. The construction of Velcro-type closures is well known and described in detail in U.S. Pat. Nos. 3,054,400 and 3,376,865 which are incorporated herein by reference.

A first pair of Velcro strips 64 are secured to the undersurface 66 of the backing 20. A corresponding pair of Velcro strips 68 are suitably secured to the fly portion 16 of the trousers 12. When the removable fly construction is positioned on the trousers fly portion 16 the Velcro strips 64 of the backing 20 engage the Velcro strips 68 of the trousers 12. In this manner the removable fly construction 10 is maintained in the desired position on the trousers 12 to create the appearance that the trousers are being worn with the fly open.

Figure 5:
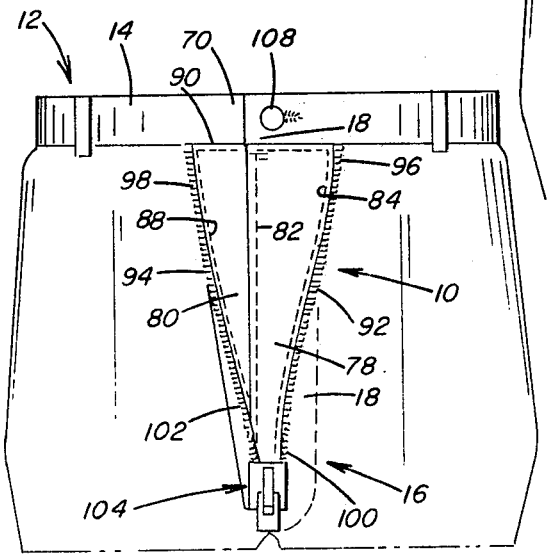
FIG. 5 is a fragmentary schematic elevation of a second embodiment of a trouser construction, illustrating an outer or imitation fly portion integrally secured to the conventional fly portion of the trouser construction to present the appearance when the trousers are worn of having the fly portion in an open position exposing the under garment.
Figure 6:
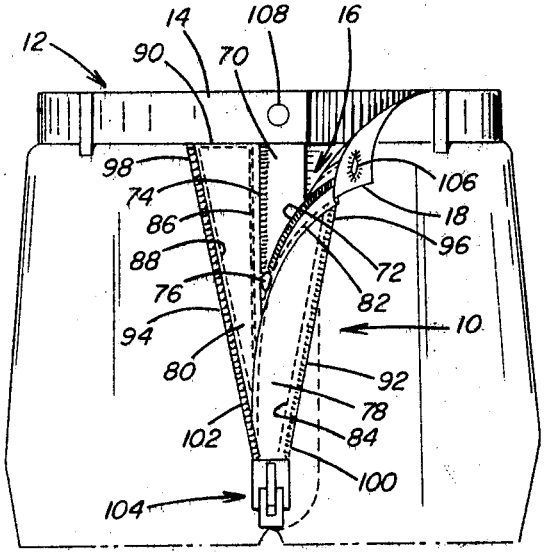
FIG. 6 is a further fragmentary schematic elevation of the trouser construction shown in FIG. 5, illustrating the outer or imitation fly portion sewn to the conventional fly portion which is concealed by the outer fly portion.

Now referring to FIGS. 5 and 6 there is illustrated another embodiment of the present invention in which the second or imitation fly construction 10 is formed integral with the trousers 12 and is supported by the conventionally operative fly portion generally designated by the numeral 16 of the trousers 12. As well known, the conventional fly portion 16 of the trousers 12 includes a first or upper flap 18 and a second or lower flap 70. The upper and lower flaps 18 and 70 are conventionally attached to the waist portion 14 and are movable relative to each other to open and close the fly portion 16.

As illustrated in FIG. 6, the fly portion 16 includes a conventional slide fastener comprising a row of teeth or track elements 72 beneath the upper flap 18 and a row of teeth or track elements 74 attached to the lower flap 70. The cooperating track elements 72 and 74 are moved into and out of meshing relation by a slide 76. FIG. 6 illustrates the conventional fly portion 16 in a partially open position. To close the fly portion 16 the slide 76 is advanced on the track elements 72 and 74 to a raised portion adjacent the trouser waist portion 14.

To obtain the desired illusionary effect of the trousers being worn with the fly portion in an open position, the second or limitation fly portion 10 is secured to the upper flap 18 and the lower flap 70. The backing for the imitation fly portion 10 in FIG. 6 includes a first backing portion 78 and a second backing portion 80. The first backing portion 78 is secured to the upper flap 18 and the second backing portion 80 is secured to the lower flap 70.

The first backing portion 78 is folded over the upper flap 18 and is stitched along an edge 82 on the undersurface of the upper flap 18 adjacent the track elements 72. The outer edge of the first backing portion 78 is stitched to the outer surface of the upper flap 18 along an edge 84. In this manner the first backing portion 78 of the imitation fly portion 10 is formed integral with the upper flap 18 of the conventionally operating fly portion 16 of the trousers 12. Similarly, the second backing portion 80 of the imitation fly portion 10 is stitched to the lower flap 70 along an edge 86 adjacent the track elements 74 and also is stitched along an edge 88 and an edge 90 to the lower flap 70.

The imitation fly portion 10 illustrated in FIGS. 5 and 6 also includes teeth or track elements 92 and 94 sewn in a conventional manner to the outer edges of the first backing portion 78 and the second backing portion 80. The track elements 92 and 94 are positioned on the first and second backing portions 78 and 80 with upper end portions 96 and 98 spaced a greater distance apart than lower end portions 100 and 102. With this arrangement, the track elements 92 and 94 converge toward one another in a direction from the upper end portions 96 and 98 to the lower end portions 100 and 102. A fly closure device or fastener generally designated by the numeral 104 is secured to and supported by the track elements lower end portions 100 and 102. Preferably, the fly closure device 104 is retained in a lowermost position as illustrated in FIGS. 5 and 6 to simulate the appearance that the trousers fly is in an open position.

As illustrated in FIG. 5 when the trousers 12 are worn with the conventional fly portion 16 in a closed position, the upper and lower flaps 18 and 70 are positioned in overlapping relation. The button hole 106 engages the button 108 at the waist portion 14. The second or imitation fly portion 10 is then positioned to give the impression that the trousers 12 are being worn with the fly portion thereof in an open position. However, in fact the conventional fly portion 16 and the elements thereof, i.e. the track elements 72 and 74 and the slide 76, are concealed by the respective backing portions 78 and 80 of the imitation fly portion 10.

Figure 7:
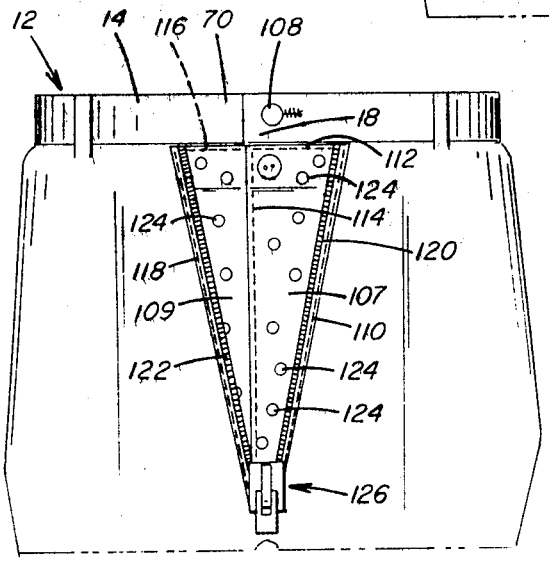
FIG. 7 is a fragmentary schematic elevation of a third embodiment of a trouser construction, illustrating an outer or imitation fly portion formed by a fabric, having the image of a trouser fly thereon, sewn to the trousers over the conventional fly to present the appearance that the trousers are being worn with an open fly.

The present invention also includes the provision, as illustrated in FIG. 7, of an imitation fly 10 formed integral with the trousers 12 similar to the embodiment illustrated in FIGS. 5 and 6 where the imitation fly 10 is formed by material having the image of a trouser fly appearing thereon. The image can be formed by any suitable photographic process. Also, the design of a fly construction can be formed on fabric material by silk screen printing and the printed fabric sewn onto the trousers. This is accomplished, as shown in FIG. 7, by attaching in the same manner as above discussed to the first and second flaps 18 and 70 of the trousers 12 backing portions 107 and 109. The backing portion 107 is stitched along the edges 110, 112, and 114 to the upper flap 18. The backing portion 109 is stitched along the edges 116 and 118 to the lower flap 70.

The backing portions 107 and 109 are printed with the image of track elements 120 and 122. The backing portion 107 includes the image of a fly closure device 126. This construction, as illustrated in FIG. 7, gives the appearance that the fly portion of the trousers is in an open position.

To further simulate the appearance of an open fly for the trousers, the respective backing portions 107 and 109 may be fabricated of a suitable material that markedly contrasts with the fabric of the trousers 12. For example the backing portions 107 and 109 may have a color clearly distinguishable from the color of the trousers 12. The backing portions 107 and 109 may also include a design such as a plurality of dots 120 as illustrated in FIG. 7.

The appearance of the backing portions 107 and 109 is preferably chosen to give the appearance that the garment which is worn under the trousers 12 is exposed as would occur if the fly portion of the trousers were actually worn in an open position. This effect enhances the illusion created by the imitation fly construction 10 on the trousers 12. Thus it will be apparent that the design of the imitation fly construction 10 is selective as determined by the use made of the trouser construction as for example in dramatic or novelty applications where the present invention is particularly adaptable.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. An article of wearing apparel comprising, a trouser construction including a waist portion and a first fly portion, said first fly portion being attached to said waist portion, means associated with said first fly portion for opening and closing said first fly portion, a second fly portion connected to said waist portion in overlying relation with said first fly portion, said second fly portion including a backing positioned on and substantially concealing said first fly portion when first fly portion is closed, said backing having a pair of spaced apart, elongated edge portions extending downwardly a preselected distance from said waist portion, fastener elements secured in overlapping relation to each of said side edge portions respectively, and said fastener elements being spaced apart a distance increasing in width from the lower ends thereof to the upper ends thereof adjacent said waist portion to present the appearance of said trouser construction as having a fly portion in an open position.

2. An article of wearing apparel as set forth in claim 1 in which, said first fly portion is formed integrally with said waist portion, and said second fly portion being removably attached to said trouser construction in overlying with said first fly portion.

3. An article of wearing apparel as set forth in claim 1 which includes, engaging means attached to said fastener elements for removably securing said second fly portion to said trouser construction in overlying relation with said first fly portion to thereby conceal said first fly portion.

4. An article of wearing apparel as set forth in claim 3 in which said engaging means includes, hook devices connected to said fastener elements for releasably engaging said waist portion, and said hook devices being engagable with said waist portion to maintain said second fly portion in overlying relation with said first fly portion in a closed position.

5. An article of wearing apparel as set forth in claim 3 in which said engaging means includes, cooperating snap devices positioned on said waist portion and said backing portion to permit releasable engagement of said second fly portion to said trouser construction in overlying relation with said first fly portion to substantially conceal said first fly portion when in a closed position.

6. An article of wearing apparel as set forth in claim 3 in which said engaging means includes, cooperating Velcro strips oppositely positioned on said trouser construction and said second fly portion for removably securing said second fly portion to said trouser construction, said cooperating Velcro strips being concealed by said second fly portion when secured to said trouser construction, and said second fly portion being positioned in overlying concealing relation with said first fly portion when said first fly portion is closed and said Velcro strips on said second fly portion engage said oppositely positioned Velcro strips on said trouser construction.

7. An article of wearing apparel as set forth in claim 1 in which, said fastener elements include strips of tape suitably attached to said elongated edge portions of said backing, said strips of tape each having upper and lower end portions, said strips of tape being positioned on said backing with said upper end portions spaced a greater distance apart than said lower end portions so that said strips of tape converge toward one another in a direction from said upper end portions to said lower end portions, and fly closure means connecting said strips of tape at said lower end portions thereof for simulating said second fly portion in an open position.

8. An article of wearing apparel as set forth in claim 1 in which, said backing includes a fabric material having a uniform fabric construction in contrasting relationship with said trouser construction and thereby distinguishable from said trouser construction.

9. An article of wearing apparel as set forth in claim 1 in which, said first fly portion includes an upper flap and a lower flap, said upper and lower flaps being attached to said waist portion and movable relative to each other to open and close said first fly portion, said upper flap being positioned in overlying relationship with said lower flap when said first fly portion is closed, fly closure means secured to said upper and lower flaps for moving said upper flap into overlying relation with said lower flap to close said first fly portion, said backing including a first portion being secured in overlying, concealing relationship with said upper flap and a second portion being secured in overlying, concealing relationship with said lower flap, and said backing first and second portions being positioned in overlying relationship when said first fly portion is closed so that said second fly portion simulates the appearance of said trouser construction having a fly portion in an open position.

10. An article of wearing apparel comprising, a trouser construction including a waist portion and first fly portion, said first fly portion having a pair of flaps, fastener means secured to said first fly portion for moving said pair of flaps into and out of overlapping relationship to close and open said first fly portion respectively, a second fly portion positioned in overlying relationship with said first fly portion, said second fly portion including a two part backing secured to and covering said pair of flaps so that said backing parts are arranged in overlapping relationship when said first flap portion is closed, and fly fastener elements secured to said respective parts of said backing in a position to simulate the appearance of said trouser construction having the trouser fly portion in an open position when said first fly portion is closed.

11. An article of wearing apparel as set forth in claim 10 in which, said two part backing is constructed of a material contrasting in design with the material of said trouser construction to create the appearance of exposing a garment worn under said trouser construction.

12. An attachment to a trouser construction comprising, a flexible backing having a pair of elongated side edges, means for releasably securing said backing to the trouser construction, a pair of strips secured to said pair of side edges respectively, said pair of strips each having an upper end portion and a lower end portion, said strips being positioned on said backing with said upper end portions spaced a greater distance apart than said lower end portions so that said strips converge toward one another in a direction from said upper end portions to said lower end portions, a portion of said backing being exposed between said pair of strips, fly closure means secured to said pair of strips for simulating the appearance of a fly portion for the trouser construction, and said fly closure means being positioned on said pair of strips to present the appearance of a fly portion in an open position.

13. An attachment to a trouser construction as set forth in claim 12 in which, said flexible backing being fabricated of a fabric material having a preselected color and design to create the appearance of a garment worn under the trouser construction in combination with the fly closure means to thereby simulate the appearance of the trouser construction being worn with a fly portion in an open position.

14. An attachment to a trouser construction as set forth in claim 12 in which, said means for releasably securing said backing to the trouser construction includes engagement devices connected to said pair of strips, and said engagement devices being operable to releasably engage the trouser construction to maintain said flexible backing in a preselected position on the trouser construction to give the appearance of the trouser construction having a fly portion in an open position.

15. An attachment to a trouser construction as set forth in claim 12 which includes, fly fastener elements secured to said pair of strips, and said fly closure means engaging said fly fastener elements at said lower end portions of said strips to simulate a fly construction in an open position.

* * * * *